US011225354B2

(12) United States Patent
Dixon

(10) Patent No.: US 11,225,354 B2
(45) Date of Patent: Jan. 18, 2022

(54) TAMPER EVIDENT TUCK END CONTAINERS

(71) Applicant: WestRock MWV, LLC, Atlanta, GA (US)

(72) Inventor: Rodney D. Dixon, Burlington, NC (US)

(73) Assignee: WESTROCK MWV, LLC, Atlanta, GA (US)

( * ) Notice: Subject to any disclaimer, the term of this patent is extended or adjusted under 35 U.S.C. 154(b) by 0 days.

(21) Appl. No.: 16/615,270

(22) PCT Filed: May 25, 2018

(86) PCT No.: PCT/US2018/034671
§ 371 (c)(1),
(2) Date: Nov. 20, 2019

(87) PCT Pub. No.: WO2018/222540
PCT Pub. Date: Dec. 6, 2018

(65) Prior Publication Data

US 2020/0095015 A1 Mar. 26, 2020

Related U.S. Application Data

(60) Provisional application No. 62/512,937, filed on May 31, 2017.

(51) Int. Cl.
*B65D 5/54* (2006.01)
*B65D 5/20* (2006.01)

(52) U.S. Cl.
CPC ..... *B65D 5/541* (2013.01); *B65D 5/20* (2013.01); *B65D 2401/10* (2020.05)

(58) Field of Classification Search
CPC .. B65D 5/541; B65D 5/20; B65D 2101/0015; B65D 5/0227; B65D 5/0236; B65D 5/54; B65D 2401/00; B65D 5/5415
USPC ..... 229/102, 240, 207, 132, 193, 241, 243, 229/925; 206/807
See application file for complete search history.

(56) References Cited

U.S. PATENT DOCUMENTS 3,109,577 A * 11/1963 Knipp ..... B65D 5/5435 229/228
4,917,288 A * 4/1990 Heitele ..... B65D 5/5405 229/102
RE33,573 E * 4/1991 Froom ..... B65D 5/5435 493/151
5,036,981 A * 8/1991 Johansson ..... B65D 5/5455 229/240
5,242,106 A * 9/1993 Gulliver ..... B65D 5/2004 229/120

(Continued)

*Primary Examiner* — Christopher R Demeree
(74) *Attorney, Agent, or Firm* — Neil G. Cohen

(57) ABSTRACT

A blank for forming a tamper evident container includes a plurality of panels connected together at fold lines configured for extending at least partially around an interior space, including a first side panel, a top panel, a second side panel and a bottom panel. A bottom flap is foldably connected to an edge of the bottom panel on the first end of the blank. A top flap is foldably connected to an edge of the top panel on the first end of the blank. The top flap includes a major flap and a minor flap. The major flap connects between the top panel and the minor flap. The major flap includes a tamper evident access feature.

18 Claims, 6 Drawing Sheets

(56) References Cited

U.S. PATENT DOCUMENTS

| | | | | |
|---|---|---|---|---|
| 5,330,099 | A * | 7/1994 | Beales | B65D 5/443 229/125.08 |
| 5,505,374 | A * | 4/1996 | Stone | B65D 5/0263 229/145 |
| 10,065,761 | B2 * | 9/2018 | Kansburg | B65D 5/5425 |
| 10,479,547 | B2 * | 11/2019 | Sumitomo | B65D 5/0254 |
| 2008/0083822 | A1 * | 4/2008 | Benes | B65D 5/422 229/185.1 |

* cited by examiner

TAMPER EVIDENT TUCK END CONTAINERS

CROSS-REFERENCE TO RELATED APPLICATIONS

This application is a National Phase application of PCT Application PCT/US18/034671, filed May 25, 2018, which claims the benefit of U.S. Provisional Patent Application No. 62/512,937, filed May 31, 2017, which is incorporated herein by reference in its entirety.

REFERENCE TO RELATED APPLICATION

This application claims the benefit of priority under 35 U.S.C. § 119(e) of U.S. provisional application Ser. No. 62/512,9237 filed on May 31, 2017, which is hereby incorporated by reverence in its entirety.

BACKGROUND OF THE INVENTION

1. Field of the Invention

The present disclosure relates to packaging, and more particularly to tamper evident packaging.

2. Description of Related Art

A variety of packaging schemes are used to provide tamper evidence to protect product within containers. Tamper evident features can either deter unauthorized tampering or clearly indicate whether unauthorized tampering has occurred, or both. This can allow a consumer or merchant to easily see whether the package has been opened or compromised, which can be beneficial for example in the case of packaged content that may be compromised if the packaging has been opened before purchase. Tamper evident features are desirable in applications such as over the counter medicines and prescription pharmaceuticals.

The conventional techniques have been considered satisfactory for their intended purpose. However, there is an ever present need for improved tamper evident packaging. This disclosure provides a solution for this problem.

SUMMARY OF THE INVENTION

A blank for forming a tamper evident container includes a plurality of panels connected together at fold lines configured for extending at least partially around an interior space, including a first side panel, a top panel, a second side panel and a bottom panel. A first side flap is foldably connected to an edge of the first side panel on a first end of the blank. A bottom flap is foldably connected to an edge of the bottom panel on the first end of the blank. A second side flap is foldably connected to an edge of the second side panel on the first end of the blank. A top flap is foldably connected to an edge of the top panel on the first end of the blank. The top flap includes a major flap and a minor flap. The major flap connects between the top panel and the minor flap. The major flap includes a tamper evident access feature.

The major flap can connects to the minor flap along a perforation line. The tamper evident access feature of the major flap can be positioned along the perforation line connecting the major and minor flaps. The tamper evident access feature can include a portion of the major panel that is lunate shaped. The tamper evident access feature can be defined by an arced nick line.

The major flap can include at least one release area surrounded by a weakened periphery. The major flap can include two release areas, one on each of two opposed sides of the tamper evident access feature.

A side flap can be foldably connected to an edge of the first side panel on a second end of the blank opposite the first end. A second bottom flap can be foldably connected to an edge of the bottom panel on the second end of the blank. A side flap can be foldably connected to an edge of the second side panel on the second end of the blank. A second top flap can be foldably connected to an edge of the top panel on the second end of the blank. The second top flap can include a major flap and a minor flap, the major flap connecting between the top panel and the minor flap, wherein the major flap includes a tamper evident access feature. The major and minor flaps of the second top flap can be connected along a perforation line. The major flap of the second top flap can include at least one release area surrounded by a weakened periphery.

A tamper evident container includes a plurality of panels connected together at fold lines and extending at least partially around an interior space, including a first side panel, a top panel, a second side panel and a bottom panel and flaps as described above. The major and minor flaps can be adhered together with adhesive on the at least one release area. The first and second side flaps, the top flap, and the bottom flap can be left open for filling the interior space with product. The major and minor flaps of the second top flap can be connected along a perforation line, wherein the major flap of the second top flap can include at least one release area surrounded by a weakened periphery that is adhered to the minor flap, wherein the flaps of the second end of the blank can be adhered together to form a closed end of the container.

A method of assembling a tamper evident container includes forming a plurality of panels to wrap at least partially around an interior space as described above. The method includes adhering the major and minor flaps together to cover the tamper evident access feature. Adhering the major and minor flaps together can include adhering the major and minor flaps together only at release features defined by weakened peripheries in at least one of the major and minor flaps.

These and other features of the systems and methods of the subject disclosure will become more readily apparent to those skilled in the art from the following detailed description of the preferred embodiments taken in conjunction with the drawings.

BRIEF DESCRIPTION OF THE DRAWINGS

So that those skilled in the art to which the subject disclosure appertains will readily understand how to make and use the devices and methods of the subject disclosure without undue experimentation, preferred embodiments thereof will be described in detail herein below with reference to certain figures, wherein.

DETAILED DESCRIPTION OF THE PREFERRED EMBODIMENTS

Figure 1:
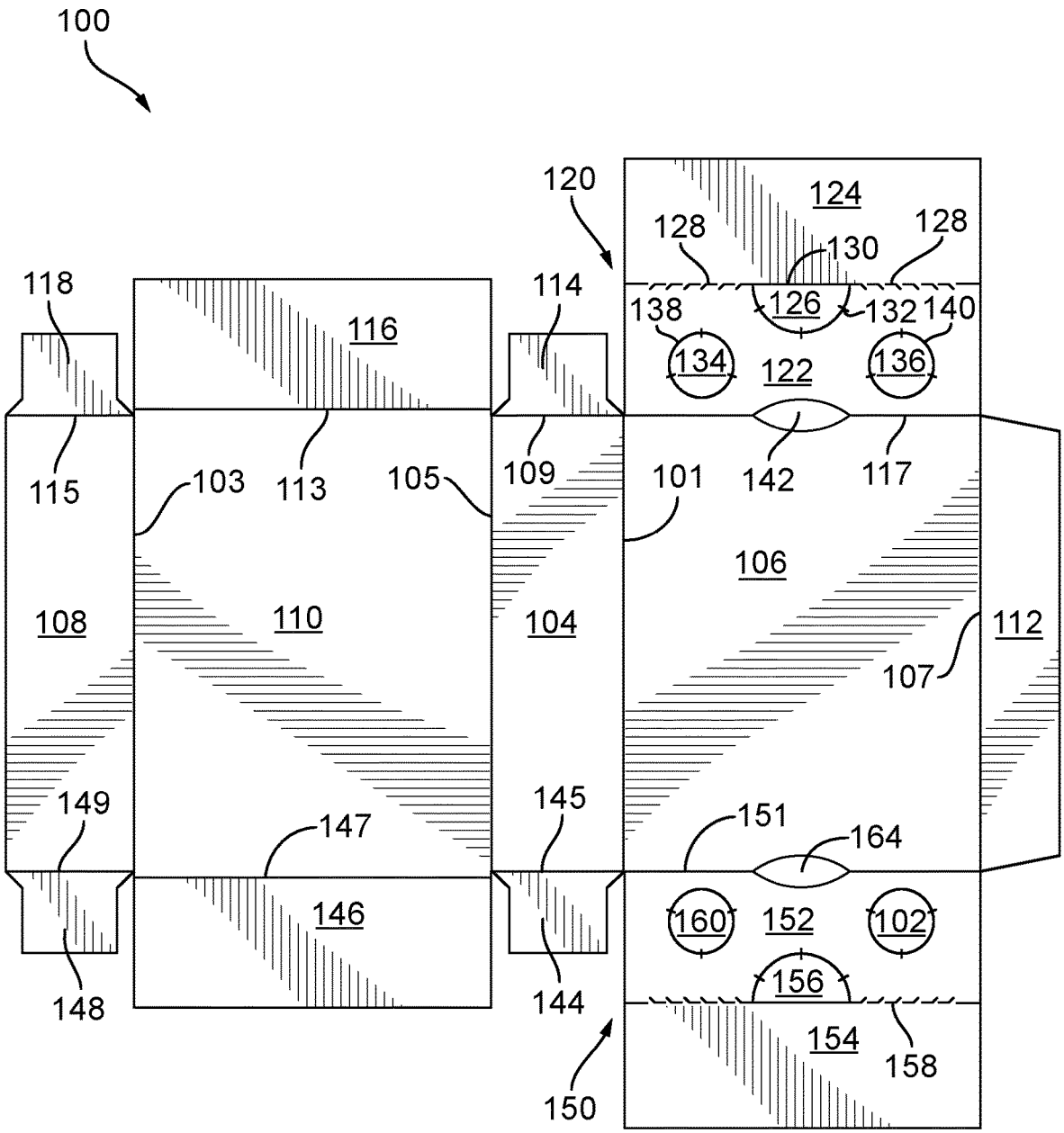
FIG. 1 is a plan view of an exemplary embodiment of a packaging blank constructed in accordance with the present disclosure, showing the tamper evident features.

Reference will now be made to the drawings wherein like reference numerals identify similar structural features or aspects of the subject disclosure. For purposes of explanation and illustration, and not limitation, a partial view of an exemplary embodiment of a blank in accordance with the disclosure is shown in FIG. 1 and is designated generally by reference character 100. Other embodiments of blanks in accordance with the disclosure, or aspects thereof, are provided in FIGS. 2-6, as will be described. The systems and methods described herein can be used to provide tamper evident packaging, e.g., for pharmaceutical products and the like.

The blank 100 for forming a tamper evident container 102, shown in FIGS. 2-6, includes a plurality of panels connected together at fold lines configured for extending at least partially around an interior space, i.e. the inside of the container 102 shown in FIGS. 2-6. The plurality of panels includes a first side panel 104 connected to a top panel 106 along fold line 101, and a second side panel 108 connected along a fold line 103 to a bottom panel 110, which is in turn connected to the first side panel along a fold line 105. An adhesive flap 112 is connected to the top panel 106 along a fold line 107. Blank 100 can be constructed of any suitable paper board material and/or tear resistant material.

A first side flap 114 is foldably connected to fold line 109 along an edge of the first side panel 104 on a first end, i.e. the top end as oriented in FIG. 1, of the blank 100. A bottom flap 116 is foldably connected along fold line 113 to an edge of the bottom panel 110 on the first end of the blank 100. A second side flap 118 is foldably connected along a fold line 115 to an edge of the second side panel 108 on the first end of the blank 100. A top flap 120 is foldably connected along a fold line 117 to an edge of the top panel 106 on the first end of the blank 100. The top flap 120 includes a major flap 122 and a minor flap 124. The major flap 122 connects between the top panel 106 and the minor flap 124.

The major flap 122 includes a tamper evident access feature 126. The major flap 122 connects to the minor flap 124 along a perforation line 128 which is interrupted by the perforation or score line 130 connecting the tamper evident access feature 126 to the minor flap 124. The tamper evident access feature 126 of the major flap is positioned along the perforation line 128 connecting the major and minor flaps 122 and 124. The tamper evident access feature 126 includes a portion of the major panel 126 that is lunate shaped as defined by a nicked arc line 132. The major flap 122 includes two release areas 134 and 136 on each of two opposed sides of the tamper evident access feature 126. Each of the release areas 134 and 136 is surrounded by a weakened, circular periphery 138 and 140, e.g., 50% depth cuts all around each circular periphery. Fold line 117 includes an access area 142 defined between two arcs of the fold line 117.

The flaps of the first end, i.e. the top as oriented in FIG. 1, of blank 100 are described above. The second end, i.e., the bottom as oriented in FIG. 1, of blank 100 has a similar set of flaps, wherein the fold lines and features are essentially mirrored. A side flap 144 is foldably connected along a fold line 145 to an edge of the first side panel 104. A second bottom flap 146 is foldably connected along a fold line 147 to an edge of the bottom panel 110. A side flap 148 is foldably connected along a fold line 149 to an edge of the second side panel 108. A second top flap 150 is foldably connected along a fold line 151 to an edge of the top panel 106. The second top flap includes a major flap 152 and a minor flap 154, the major flap 152 connecting between the top panel 106 and the minor flap 154. The major flap 152 is essentially the same as the major flap 122 on the opposite end of the blank 100 and includes a tamper evident access feature 156, an access area, a perforation line 158, and release areas 160 and 162 as described above with respect to major flap 122.

Figure 2:
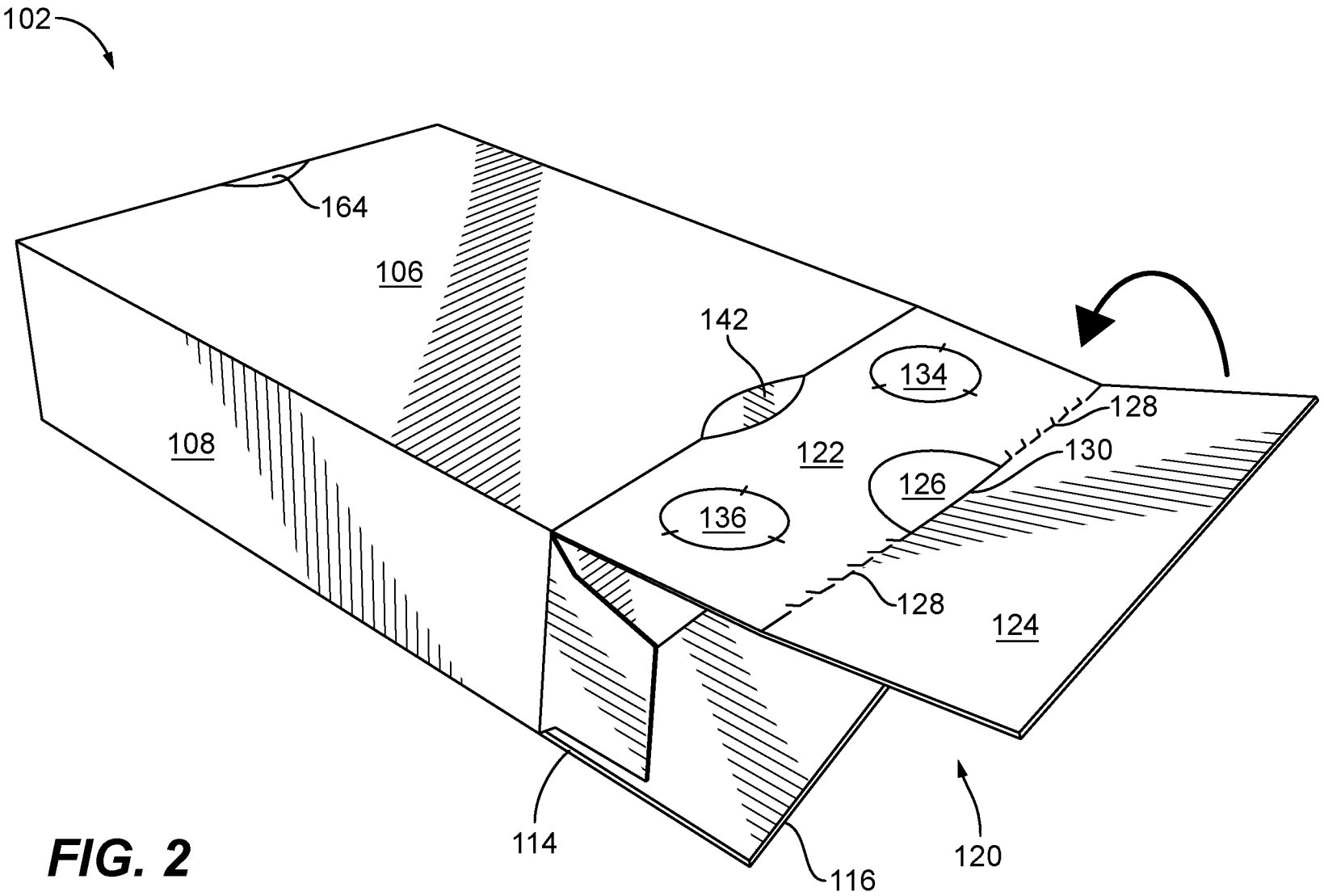
FIG. 2 is a perspective view of the packaging blank of FIG. 1, showing the packaging blank being formed into a container for receiving contents.

With reference now to FIG. 2, a tamper evident container 102 is shown constructed from the blank 100 of FIG. 1. In FIG. 2, the adhesion flap 112 is adhered to the inside of the side flap 108, and fold lines 101, 103, 105, and 107 are folded to wrap side panels 108 and 104 and top and bottom panels 106 and 110 around the interior space for receiving product as shown in FIG. 2. In FIG. 2, the flaps 144, 146, 148, and 150 are adhered to form a closure on the second end of the container 102, which closure is formed in the same manner as the closure on the first end of container 102. The closure of the first end of the container 102, i.e. the top end as oriented in FIG. 1 or the foreground end as oriented in FIG. 2, will now be described.

The major and minor flaps 122 and 124 are adhered together with adhesive only on the release areas 134 and 136, the rest of the area where major and minor flaps 122 and 124 contact each other is kept free of adhesive. After adhesive is applied, the major and minor flaps 122 and 124 can be joined by folding along perforation line 128 as indicated by the large arrow in FIG. 2. This covers the tamper evident access feature 126 with minor flap 124.

Figure 3:
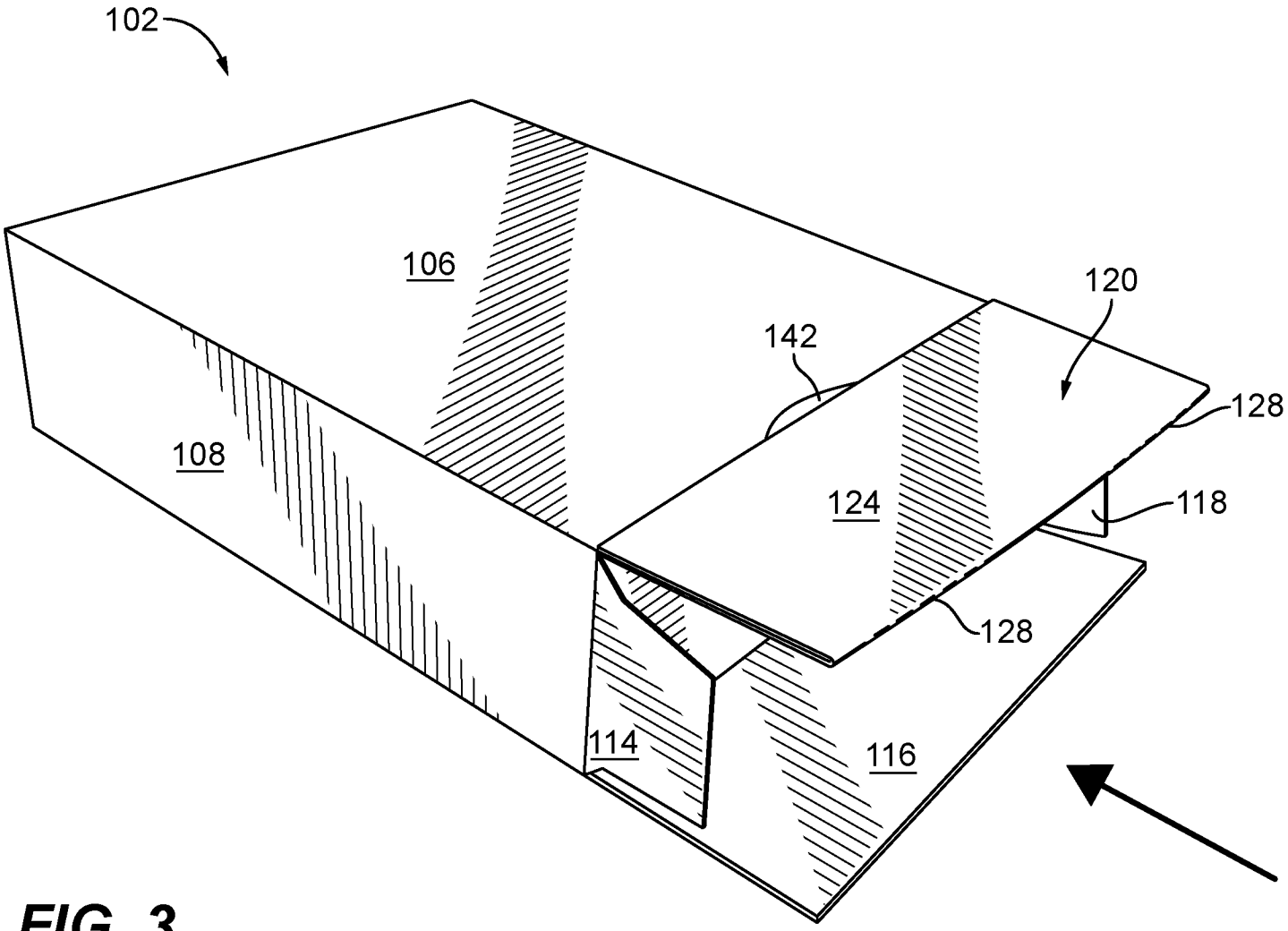
FIG. 3 is a perspective view of the container of FIG. 2, showing a stage in the closure of the container ready to receive contents inside.
Figure 4:
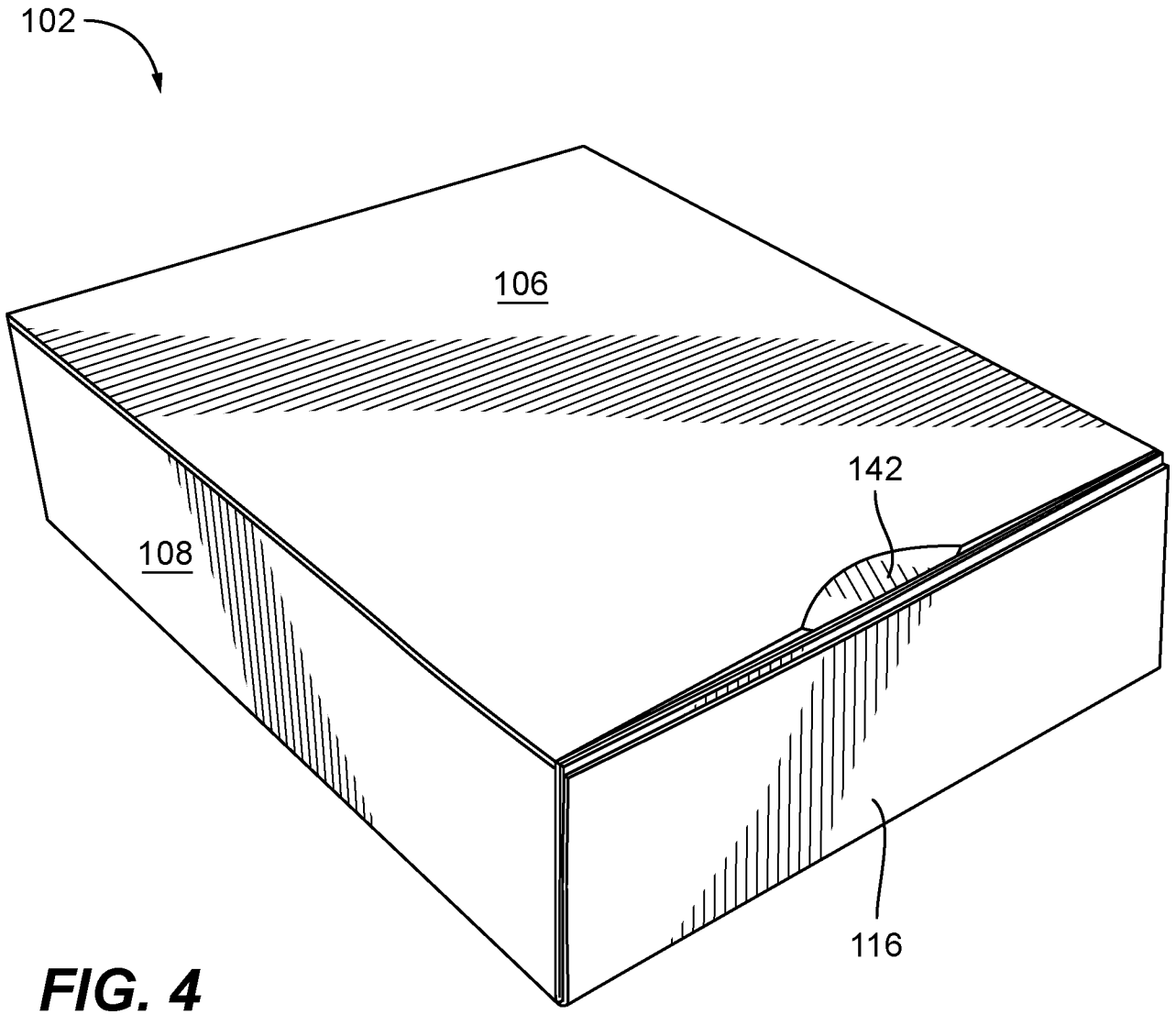
FIG. 4 is a perspective view of the container of FIG. 2, showing the container completely formed with both ends sealed.

With reference now to FIG. 3, the major and minor flaps 122 and 124 of top flap 120 are shown adhered together. The first and second side flaps 114 and 118, the top flap 120, and the bottom flap 116 can be left open for filling the interior space with product as indicated by the large arrow in FIG. 3. In other words, the container 102 can be prepared to the point shown in FIG. 3 at a first facility for making containers, and can be shipped to a second facility to be filled with a product as shown in FIG. 4 where the bottom flap 116 is then adhered over the top flap 120 with side flaps 114 and 118 folded in to form a closure on the first end of the container 102. Those skilled in the art will readily appreciate that while shown and described in an exemplary context where the second end of the container 102 is already closed before product is placed in container 102, both ends of the container 102 can be left open for subsequent filling of product into the interior space, and then both ends can be closed, e.g., at a second facility where product is placed in the container 102, in the same manner as described above with respect to top flap 120. Either way, both ends of container 102 can ultimately be glued or sealed to secure the product inside.

Figure 5:
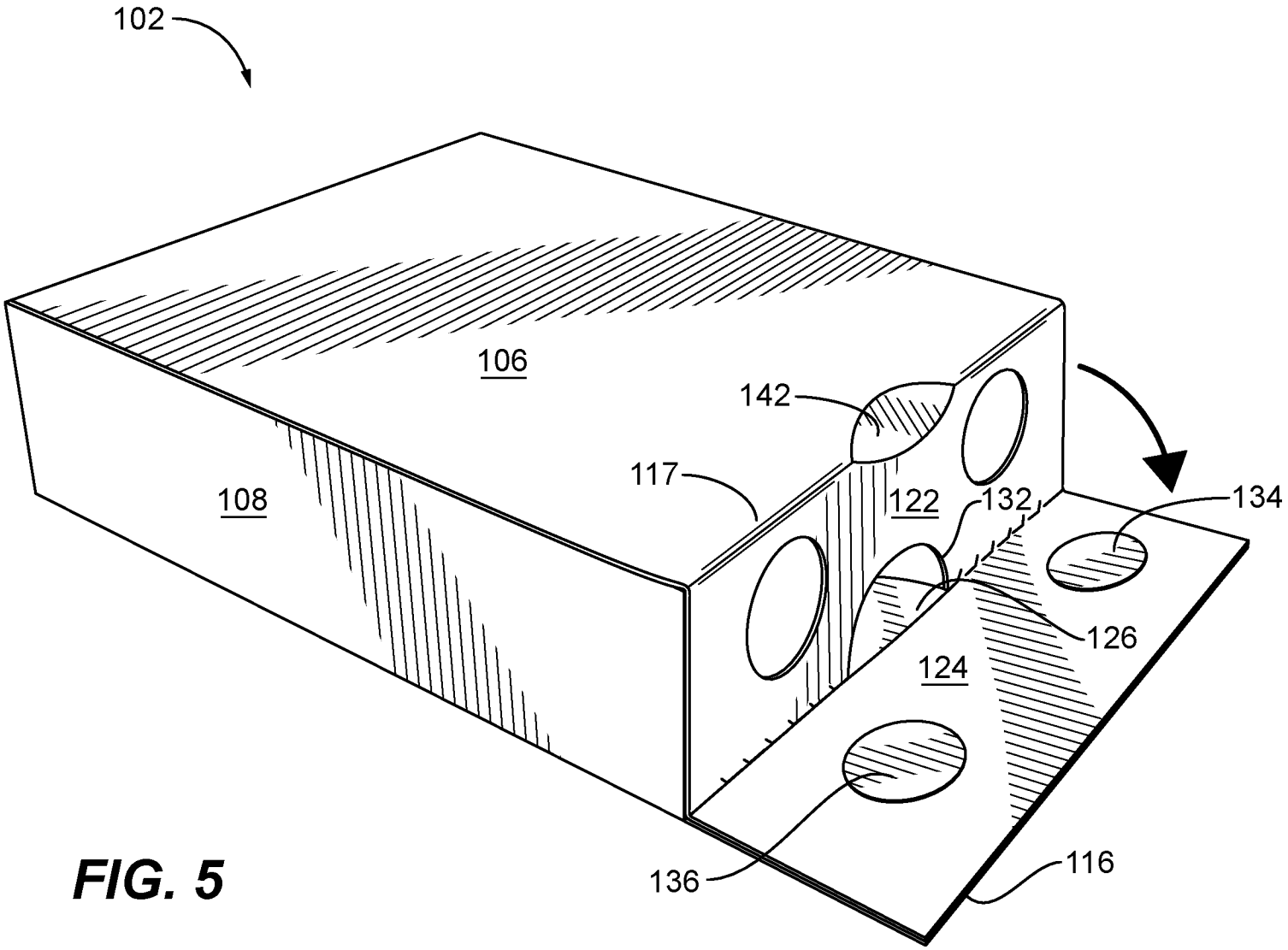
FIG. 5 is a perspective view of the container of FIG. 2, showing the container after an initial stage of opening, with tamper evident features activated.
Figure 6:
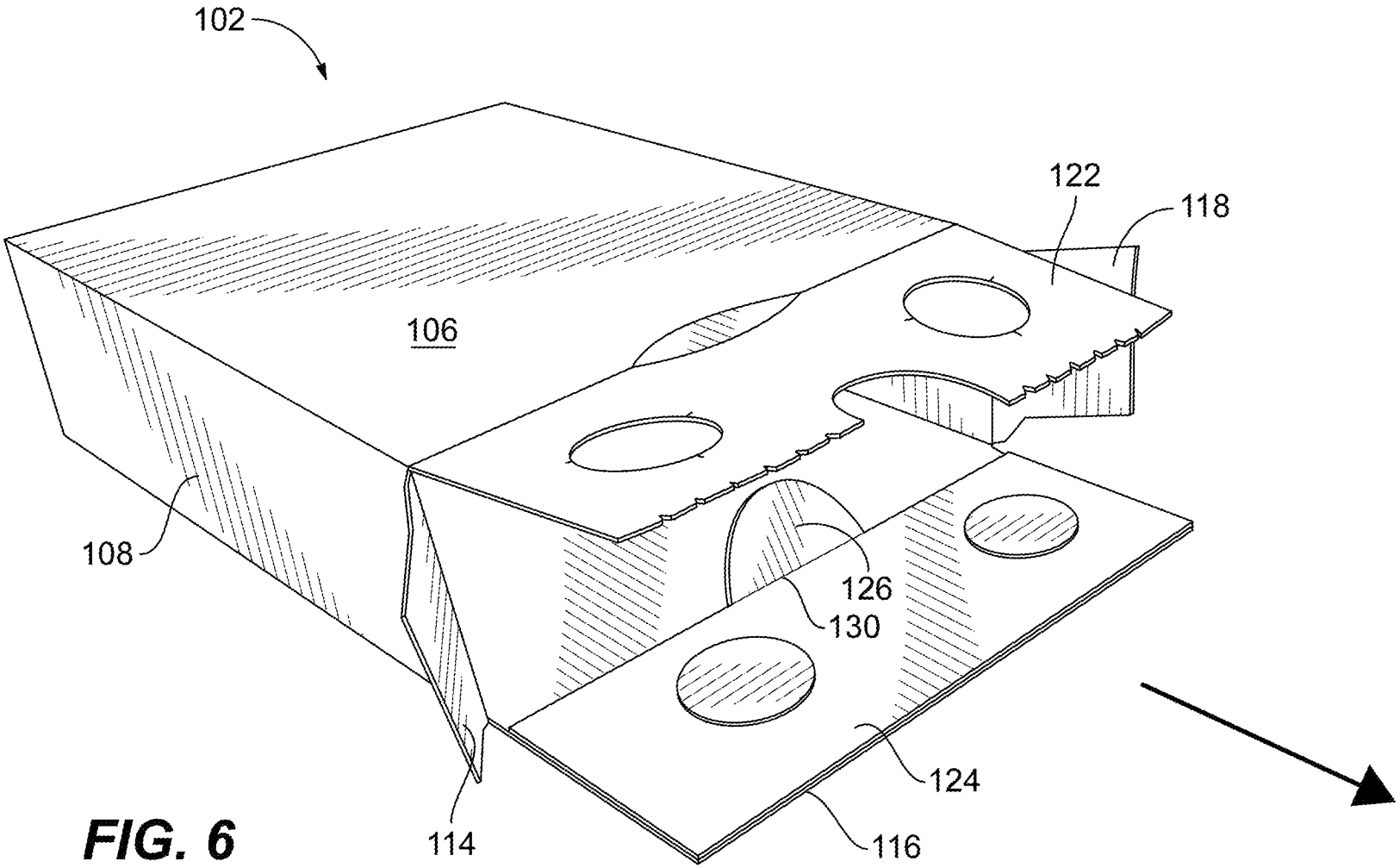
FIG. 6 is a perspective view of the container of FIG. 2, showing the container fully opened with all tamper evident features activated.

With reference now to FIG. 5, to initiate opening container 102 to access the product inside, a consumer can depress the access area 142, e.g. using a thumb, and then the consumer can pull the major and minor flaps 122 and 124 apart as indicated by the large arrow in FIG. 5. Since the major and minor flaps 122 and 124 are only glued or adhered together at the release areas 134 and 136, as the consumer pulls downward on minor flap 124, the weakened peripheries around the release part of areas 134 and 136 break and at least the partial thickness of release areas 134 and 136 are removed from major panel 122 and remain adhered to minor panel 124, which in turn can remain adhered to bottom panel 116. This reveals the tamper evident access feature 126. The consumer can press inward on tamper evident access feature 126 to break the nicked arc line 132 shown in FIG. 1. This moves the tamper evident access feature 126 inward, pivoting it on perforation or score line 130, to allow the consumer to lift upward against the edge of the nicked arc line 132 to lift major panel 122 by breaking the perorations of perforation line 128. The consumer can then pivot major panel 122 upward on fold line 117 to fully open the container 102 as shown in FIG. 6. The tamper evident access feature 126 can then be left hanging on perforation or score line 130. The product can then be removed from the interior space of the container 102 as indicated by the large arrow in FIG. 6. Those skilled in the art will readily appreciate that the opposite end of container 102 can be opened in the same manner described above with reference to the end with major and minor flaps 122 and 124.

Tamper evident access feature 126 can operate to tell a consumer or seller whether the product has been accessed and or compromised before its intended use. For example, if after pulling the major flap 122 down to the position shown in FIG. 5, if the nicked arc line 132 is already broken, this is evidence of tampering. If the nicked arc line 132 is not already broken, in is evidence that there has been no tampering. The tamper evident access feature 126 can be printed in a different color and/or have indicia printed thereon, such as the word "SAFE" or the like to assist in the determination described above.

Two layers of tamper evidence are provided by container 102. Evidence of tampering can include determining whether the release areas 134 and 136 are already activated, and whether the tamper evident access feature 126 is not completely attached at all nicking points.

The methods and systems of the present disclosure, as described above and shown in the drawings, provide for tamper evident packaging with superior properties including ease of use and manufacture. While the apparatus and methods of the subject disclosure have been shown and described with reference to preferred embodiments, those skilled in the art will readily appreciate that changes and/or modifications may be made thereto without departing from the scope of the subject disclosure.

What is claimed is:

1. A blank for forming a tamper evident container comprising: a plurality of panels connected together at fold lines configured for extending at least partially around an interior space, including a first side panel, a top panel, a second side panel and a bottom panel;

a first side flap foldably connected to an edge of the first side panel on a first end of the blank;

a bottom flap foldably connected to an edge of the bottom panel on the first end of the blank;

a second side flap foldably connected to an edge of the second side panel on the first end of the blank; and a top flap foldably connected to an edge of the top panel on the first end of the blank, wherein the top flap includes a major flap and a minor flap, the major flap connecting between the top panel and the minor flap, wherein the major flap includes a tamper evident access feature; wherein the minor flap is configured to be disposed in face-contacting relationship with the major flap and in face-contacting relationship with the bottom flap so as to close a first container end of a formed container.

2. The blank as recited in claim 1, wherein the major flap connects to the minor flap along a perforation line.

3. The blank as recited in claim 2, wherein the tamper evident access feature of the major flap is positioned along the perforation line connecting the major and minor flaps.

4. The blank as recited in claim 1, wherein the tamper evident access feature includes a portion of the major panel that is lunate shaped.

5. The blank as recited in claim 1, wherein the tamper evident access feature is defined by an arced nick line.

6. The blank as recited in claim 1, wherein the major flap includes at least one release area surrounded by a weakened periphery.

7. The blank as recited in claim 6, wherein the major flap includes two release areas, one on each of two opposed sides of the tamper evident access feature.

8. A blank for forming a tamper evident container comprising:

a plurality of panels connected together at fold lines configured for extending at least partially around an interior space, including a first side panel, a top panel, a second side panel and a bottom panel;

a first side flap foldably connected to an edge of the first side panel on a first end of the blank;

a bottom flap foldably connected to an edge of the bottom panel on the first end of the blank;

a second side flap foldably connected to an edge of the second side panel on the first end of the blank; and a top flap foldably connected to an edge of the top panel on the first end of the blank, wherein the top flap includes a major flap and a minor flap, the major flap connecting between the top panel and the minor flap, wherein the major flap includes a tamper evident access feature, the blank further comprising:

a side flap foldably connected to an edge of the first side panel on a second end of the blank opposite the first end;

a second bottom flap foldably connected to an edge of the bottom panel on the second end of the blank;

a side flap foldably connected to an edge of the second side panel on the second end of the blank; and a second top flap foldably connected to an edge of the top panel on the second end of the blank, wherein the second top flap includes a major flap and a minor flap, the major flap connecting between the top panel and the minor flap, wherein the major flap includes a tamper evident access feature.

9. The blank as recited in claim 8, wherein the major and minor flaps of the second top flap are connected along a perforation line.

10. The blank as recited in claim 8, wherein the major flap of the second top flap includes at least one release area surrounded by a weakened periphery.

11. A tamper evident container comprising:

a plurality of panels connected together at fold lines and extending at least partially around an interior space, including a first side panel, a top panel, a second side panel and a bottom panel;

a first side flap foldably connected to an edge of the first side panel on a first end of the blank;

a bottom flap foldably connected to an edge of the bottom panel on the first end of the blank;

a second side flap foldably connected to an edge of the second side panel on the first end of the blank; and a top flap foldably connected to an edge of the top panel on the first end of the blank, wherein the top flap includes a major flap and a minor flap, the major flap connecting between the top panel and the minor flap, wherein the major flap includes a tamper evident access feature, wherein the minor flap is disposed in face-contacting relationship with the major flap and in face-contacting relationship with the bottom flap to close a first container end when the tamper evident container is in a closed configuration.

12. The container as recited in claim 11, wherein the major flap connects to the minor flap along a perforation line, wherein the tamper evident access feature of the major flap is positioned along the perforation line connecting the major and minor flaps and includes a portion of the major panel that is lunate shaped.

13. The container as recited in claim 11, wherein the tamper evident access feature is defined by an arced nick line.

14. The container as recited in claim 11, wherein the major flap includes at least one release area surrounded by a weakened periphery.

15. The container as recited in claim 14, wherein the major and minor flaps are adhered together with adhesive on the at least one release area.

16. The container as recited in claim 15, wherein the first and second side flaps, the top flap, and the bottom flap are left open for filling the interior space with product.

17. A tamper evident container comprising:

a plurality of panels connected together at fold lines and extending at least partially around an interior space, including a first side panel, a top panel, a second side panel and a bottom panel;

a first side flap foldably connected to an edge of the first side panel on a first end of the blank;

a bottom flap foldably connected to an edge of the bottom panel on the first end of the blank;

a second side flap foldably connected to an edge of the second side panel on the first end of the blank; and a top flap foldably connected to an edge of the top panel on the first end of the blank, wherein the top flap includes a major flap and a minor flap, the major flap connecting between the top panel and the minor flap, wherein the major flap includes a tamper evident access feature, further comprising:

a side flap foldably connected to an edge of the first side panel on a second end of the blank opposite the first end;

a second bottom flap foldably connected to an edge of the bottom panel on the second end of the blank; a side flap foldably connected to an edge of the second side panel on the second end of the blank; and a second top flap foldably connected to an edge of the top panel on the second end of the blank, wherein the second top flap includes a major flap and a minor flap, the major flap connecting between the top panel and the minor flap, wherein the major flap includes a tamper evident access feature.

18. The container as recited in claim 17, wherein the major and minor flaps of the second top flap are connected along a perforation line, wherein the major flap of the second top flap includes at least one release area surrounded by a weakened periphery that is adhered to the minor flap, wherein the flaps of the second end of the blank are adhered together to form a closed end of the container.

* * * * *